United States Patent [19]

Iwaki et al.

[11] 4,180,376

[45] Dec. 25, 1979

[54] ELECTRIC FAN

[75] Inventors: Hiroshi Iwaki; Masaaki Nakamura, both of Kasai, Japan

[73] Assignee: Sanyo Electric Co., Ltd., Osaka, Japan

[21] Appl. No.: 865,687

[22] Filed: Dec. 29, 1977

[30] Foreign Application Priority Data

Feb. 23, 1977 [JP] Japan ..... 52/22837[U]
Apr. 5, 1977 [JP] Japan ..... 52/43379

[51] Int. Cl.[2] ..... F04B 35/00; F16M 7/00; F16M 9/00

[52] U.S. Cl. ..... 417/360; 248/222.1; 248/678

[58] Field of Search ..... 417/360; 248/19, 222.1, 248/678, 679

[56] References Cited

U.S. PATENT DOCUMENTS

| | | | |
|---|---|---|---|
| 3,134,564 | 5/1964 | Peterson | 248/19 |
| 3,188,038 | 6/1965 | Grout | 248/222.1 |
| 3,880,553 | 4/1975 | Wolf et al. | 418/360 |

FOREIGN PATENT DOCUMENTS

| | | | |
|---|---|---|---|
| 74927 | 3/1945 | Czechoslovakia | 248/19 |
| 47-29822 | 9/1972 | Japan | |

*Primary Examiner*—Richard E. Gluck
*Attorney, Agent, or Firm*—Armstrong, Nikaido, Marmelstein & Kubovcik

[57] ABSTRACT

An electric fan which can be disassembled into a base portion and a casing integral with a fan main body or assembled into one unit in an efficient manner through provision of a longitudinal recess in the base portion and engaging portions between the recess and casing. The casing is further provided with a power cord compartment with an improved cover plate arrangement for compactly accommodating the power cord when not in use.

7 Claims, 4 Drawing Figures

ELECTRIC FAN

BACKGROUND OF THE INVENTION

The present invention relates to an electric fan and more particularly, to a structure of an electric fan, for example, of oscillating type which is adapted to be readily disassembled into a base portion and a fan main body or assembled into one unit, and is also provided with an improved cover plate arrangement of simple construction for power cord accommodation.

Commonly, an electric fan including a base portion, a supporting arm extending upwardly from the base portion, a motor oscillatingly mounted at the upper portion of the supporting arm and having a blade assembly with a plurality of blades mounted on its shaft, and wire guards fixed to the motor to surround the fan, etc., tends to be bulky and occupy a considerable space especially at its base portion. For conveniences in packing, storing, transportation and manufacturing, some types of such electric fans are arranged to be disassembled into the base portion and fan main body including the motor, blade assembly, etc. through releasable engagement between the base portion and a casing or switch box for electrical parts provided at the lower portion of the supporting arm.

For the purpose as described above, there has conventionally been proposed one arrangement, for example, in Japanese Utility Model publication Jitsukosho 47-29822 wherein the base portion of the electric fan is provided with a longitudinal recess having a pair of grooves at its opposite sides for engagement with projections formed at corresponding sides of the casing for electrical parts provided at the lower portion of the supporting arm, and after sliding engagement of the casing and the base portion, the casing is fixed to the base portion by threading a securing screw mounted at the rear portion of the casing into a threaded opening formed in the base portion. The above known arrangement, however, has such a disadvantage that the sliding engagement or disengagement between the base portion and the casing is rather troublesome especially when the projections of the casing are to be inserted into the grooves of the base portion for assembling, while the formation of the grooves and mating projections requires a considerable accuracy during manufacturing.

Another inconvenience inherent in the known electric fans of the above described type is the presence of electric power cord extending therefrom when not in use. For storing such power cord when the electric fan is not used, there have been conventionally proposed various arrangements, most of which, however, are complicated in construction or require extra space, thus resulting in large size of electric fans and consequent high cost thereof.

SUMMARY OF THE INVENTION

Accordingly, an essential object of the present invention is to provide an electric fan capable of being disassmbled into a base portion and a fan main portion or assembled into one unit at a junction therebetween in an efficient manner especially without any difficulty in assembling.

Another important object of the present invention is to provide an electric fan of the above described type in which an electric power cord therefor can be compactly accommodated when not in use into a small compartment having an improved cover plate arrangement and formed in a casing for electric parts whereat the fan main body is selectively engaged with and disengaged from the base portion.

A further object of the present invention is to provide an electric fan of the above described type which is simple in construction and can be readily manufactured at low cost.

In accomplishing these and other objects, according to one preferred embodiment of the present invention, there is disclosed an electric fan including a casing for electric parts of rectangular cubic configuration integrally formed with a supporting arm for a motor and blade assembly, and a base portion having a longitudinal recess for receiving the casing therein, in which electric fan, an engaging portion is provided at a forward end of the longitudinal recess for engagement with a corresponding forward end of the casing, while a rib or projection tapering toward interior of the longitudinal recess is also formed in said longitudinal recess at its rear wall which is arranged to be shorter in its height than side walls defining the longitudinal recess, for engagement with a corresponding tapering face provided at the rear lower edge of the casing. When the casing is placed in the longitudinal recess for assembling, the tapering face of the casing rides over the tapering rib so as to be guided to move the casing into the longitudinal recess for securing engagement between said engaging portion at the forward end of the longitudinal recess and corresponding forward end of the casing. After insertion of the casing into the recess in the above described manner, the casing is further secured to the base portion by a screw to be threaded into the casing from under the recess. Meanwhile, the casing is further provided with an improved cover plate arrangement which includes a partition plate to be inserted between side walls of the casing and a bottom plate to close an open bottom portion of the casing and to hold the partition plate in position in the casing for dividing the casing into a first compartment for electrical parts and a second compartment for accommodating the power cord of the electric fan when not in use. The partition plate is provided at its lower edge with a cover plate integrally formed therewith through hinged portion for selectively opening and closing a cord insertion and withdrawal opening for the second compartment.

By the above arrangement, not only the electric fan is readily disassembled into the base portion and main fan body or assembled into one unit very efficiently, but the power cord of the electric fan can be compactly housed in the power cord compartment within the casing through the improved cover plate arrangement, with substantial elimination of disadvantages inherent in the convetional electric fans of the type.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
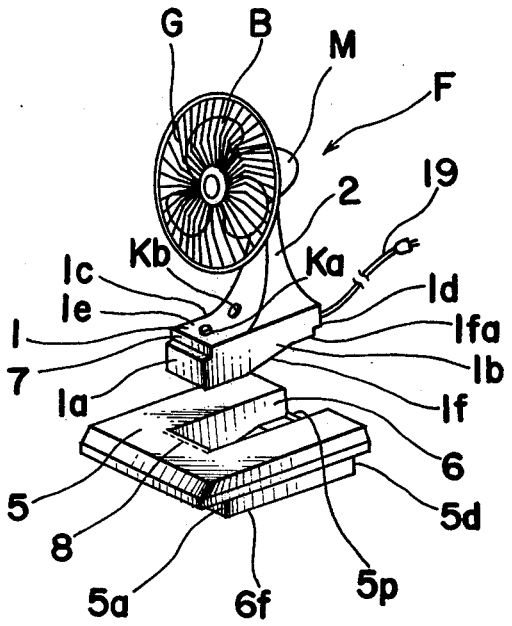
FIG. 1 is a perspective view of an electric fan to which the present invention may be applied, with a main fan body of the electric fan being disengaged from a base portion for clarity.

Referring now to the drawings, there is shown in FIG. 1 an electric fan F to which the present invention may be applied. The electric fan F generally includes a base portion 5 of rectangular box-like configuration, a casing or switch box 1 for accommodating electric parts therein integrally formed with a supporting arm 2 which extends upwardly from the casing 1, an electric motor M mounted on the upper end of the supporting arm 2, a blade assembly B having a plurality of blades and mounted for rotation on a driving shaft (not shown) of the motor M, and front and rear guard wires G secured to the front portion of the motor M for enclosing the blade assembly B therein in a known manner. The base portion 5, casing 1 with the supporting arm 2, blade assembly B, etc., may be formed with any suitable materials, for example, plastics, diecast metal, sheet metal and the like.

The casing 1 has a rectangular cubic shape defined by front and rear walls 1*a* and 1*d*, side walls 1*c* and 1*b*, a bottom wall 1*f*, and an upper forward wall 1*e* on which knobs Ka and Kb, for example, for a switch 18 and a timer T (FIG. 2) are mounted for control of rotation of the motor M, with the walls 1*a* and 1*e* except for the bottom wall 1*f* being integrally formed with corresponding walls of the supporting arm 2 as shown.

Figure 2:
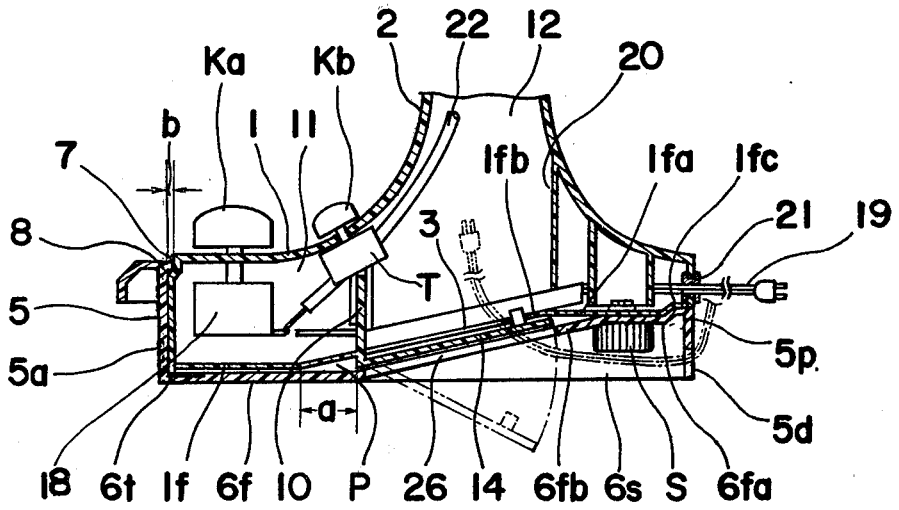
FIG. 2 is a side sectional view showing, on an enlarged scale, structure of a casing for electrical parts having a compartment for electric power cord accommodation and an improved cover plate member therefor employed in the electric fan of FIG. 1.

Referring also to FIG. 2, the base portion 5 is provided with at the central portion thereof with a longitudinal recess 6 open at its rear end, and corresponding in dimensions to the casing 1 for receiving said casing 1 thereinto, and also with an engaging projection 8 formed in the recess 6 at a forward upper edge of a front wall 5*a* of the base portion 5 for engagement with a corresponding stepped portion 7 formed at an upper forward edge of the front wall 1*a* of the casing 1, while a rear half of a bottom wall 6*f* for the recess 6 is raised through an intermediate inclined portion 6*fb* to form a raised portion 6*fa* which corresponds to a raised portion 1*fa* formed through an intermediate inclined portion 1*fb* in the bottom wall 1*f* of the casing 1. It should be noted here that the raised portion 1*fa* of the bottom wall 1*f* is arranged to be deviated in its position in a horizontal direction from the raised portion 6*fa* of the recess 6 in the engaged state of the base portion 5 and the casing 1 as shown in FIG. 2 to provide a space P between the portions 1*fb* and 6*fb*, with the length of the space P in the horizontal direction in FIG. 2 being arranged to be longer than a height or depth b of the engaging projection 8 at the forward end of the recess 6 mentioned earlier. Additionally, at the open rear end of the recess 6, there is further provided an engaging portion, i.e., a rib or guide projection 5*p* having a surface tapering toward interior of the recess 6 and formed along an upper edge of a rear wall 5*d* of the recess 6 which is lower in its height than side walls of said recess 6 for engagement with a corresponding stepped portion or guide recess 1*fc* having a tapering surface which rides over the tapering rib 5*p* and formed at a rear end of the bottom wall 1*f* of the casing 1. Furthermore, in a space 6*s* defined below the raised bottom portion 6*fa* of the recess 6, there is provided a set screw S to be threaded into a corresponding threaded opening 9 (FIG. 4) formed in the raised portion 1*fa* for rigidly connecting the base portion 5 with the casing 1, while the head of the screw S has such a size as to be fully accommodated in the space 6*s*. Moreover, at the forward portion in the inner surface of the bottom wall 6*f* of the recess 6, there is provided a shallow recess 6*t* in a position adjacent to the front wall 5*a* for providing an angle of relief to the forward lower edge of the casing 1 when the casing 1 is to be withdrawn from the recess 6.

It should be noted here that the tapering surfaces described as formed both in the engaging portion or rib 5*b* of the recess 6 and the corresponding stepped portion 1*fc* of the casing 1 in the above embodiment may be modified to be formed either one of the rib 5*b* or stepped portion 1*fc* so long as such tapering surface is effective for guiding the casing 1 into the recess 6, and that the rib 5*p* of the recess 6 and the corresponding stepped portion 1*fc* of the casing 1 described as formed each at one position at the rear of the recess 6 and casing 1 may further be modified to be formed at a plurality of positions in stepped manner along the corresponding bottom walls of the recess 6 and the casing 1 for further ensuring positive engagement between the casing 1 and recess 6.

Figure 3:
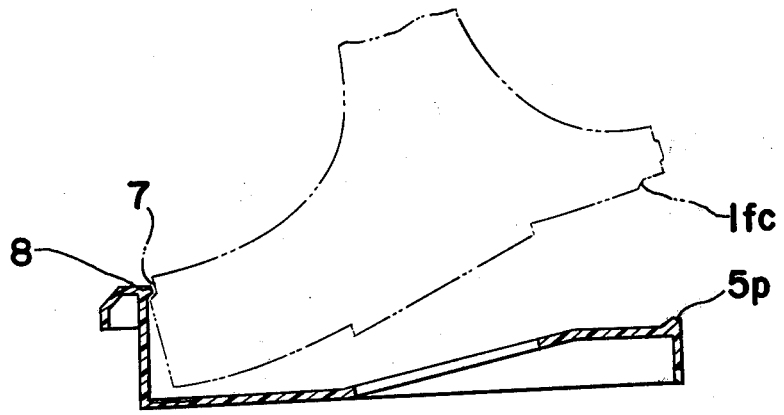
FIG. 3 is a similar view to FIG. 2, but particularly shows the casing for electric parts in dotted line at a raised position.

By the above arrangement, when the casing 1 together with the electric fan main body is introduced into the recess 6 of the base portion 5, the tapering guide recess 1*fc* at the rear end of the casing 1 rides over the tapering rib or guide projection 5*p* at the rear portion of the recess 6, and is guided along the tapering face of the projection 5*p* to move the casing 1 forward for engagement of the stepped portion 7 with the corresponding projection 8 of the recess 6, while the screw S is subsequently inserted from under the base portion 5 and threaded into the threaded opening 9 in the raised portion 1*fa* for rigid connection between the base portion 5 and the electric fan main body. On the contrary for separating the casing 1 from the base portion 5, after removal of the screw S, the rear end of the casing 1 is slightly lifted as shown in FIG. 3 for disengagement of the guide recess 1*fc* from the tapering guide projection 5*p* of the recess 6, with subsequent withdrawal of the casing 1 toward the right in FIG. 2 to disengage the stepped portion 7 of the casing 1 from the projection 8 of the recess 6, and then the casing 1 together with the fan main body is removed from the recess 6. In this case, since the length a of the space P between the bottom wall 1*f* of the casing 1 and the bottom portion 6*f* of the recess 6 in the horizontal direction is arranged to be larger than the depth b of the engagement between the stepped portion 7 of the casing 1 and projection 8 of the recess 6 as stated earlier, it is easy to move the casing 1 rearward for disengagement of the stepped portion 7 from the projection 8, while such movement of the casing 1 is further facilitated by the presence of the shallow recess 6t in the recess 6.

It should be noted here that the concept of the arrangement of the present invention is not limited to the above embodiment alone, but may further be modified or simplified depending on the necessity. More specifically, the bottom portions of the casing 1 and the recess 6 described as raised at the rear portions in the foregoing embodiment may be modified to be flat for engagement therebetween, without provision of the space P between the bottom portions 1*f* and 6*f*, with other construction remaining generally similar to that in the embodiment of FIG. 2.

Figure 4:
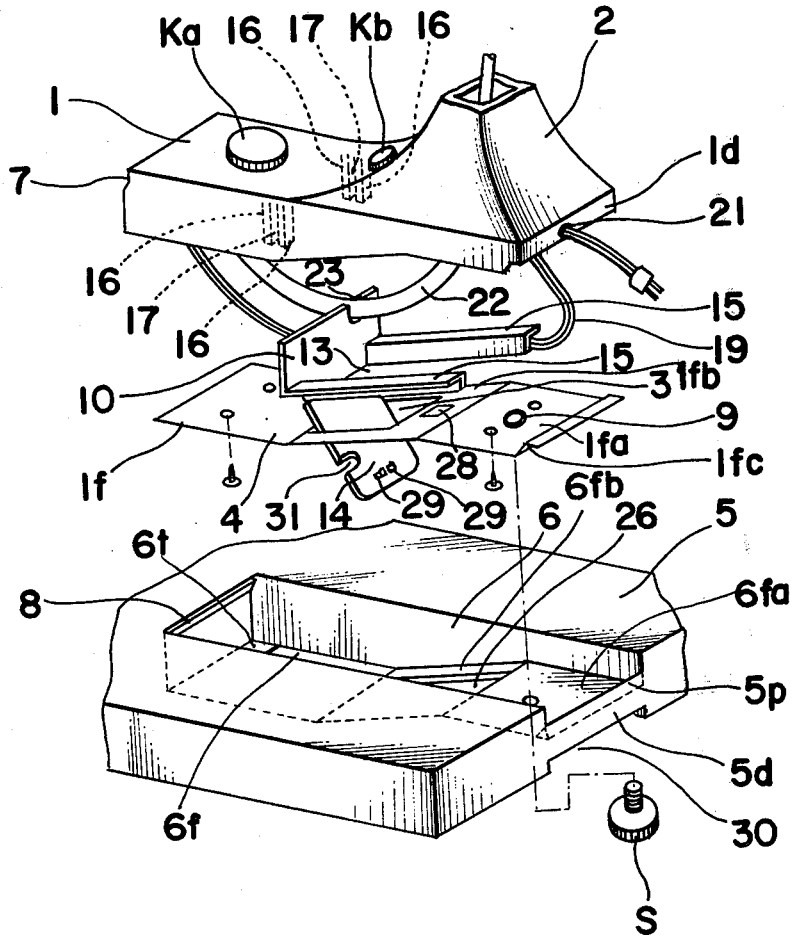
FIG. 4 is an exploded view, partly broken away, of the electric fan of FIG. 1, particularly showing construction of the base portion and the casing having an improved cover plate arrangement.

Referring also to FIG. 4, the bottom wall 1*f* including the raised portion 1*fa* for the casing 1 mentioned earlier is formed by a shaped bottom plate 4, and at the inclined portion 1*fb* thereof connecting the portions 1*f* and 1*fa*, a rectangular opening 3 is formed for insertion and withdrawal of an electric power cord 19 therethrough, while at the corresponding inclined portion 6*fb* connecting the bottom portion 6*f* and raised portion 6*fa* of the recess 6, another rectangular opening 26 is formed for communication with the opening 3 of the bottom plate 4. On the other hand, in the casing 1, there is provided a partition plate 10 which divides the interior of the casing 1 into a compartment 11 for housing the electric parts and another compartment 12 for accommodating the power cord 19 extending out of the casing 1 when not in use. A cover plate member 14 is connected or integrally formed with the lower edge of the partition plate 10 through a hinged portion 13 of thin thickness for selective opening and closing of the cord compartment 12 at the cord insertion and withdrawal opening 3 of the bottom plate 4, while a pair of cord guiding members 15 each having L-shaped cross section laterally extend from opposite lower sides of the partition plate 10 along side edges of the cord insertion and withdrawal opening 3. Additionally, a pair of ribs 16 each having a vertical groove 17 formed therein are provided on the inner side walls 1*b* and 1*c* of the casing 1 for receiving therein the partition plate 10. For assembling, the partition plate 10 is inserted into the grooves 17, and after the power cord 19 led out from the switch 18 in the compartment 11 has been passed under either one of the cord guiding members 15, the bottom plate 4 is secured to the open bottom portion of the casing 1, for example, with set screws, so that the cord guide members 15 are tightly held between the ribs 16 and the bottom plate 4 so as to fix the partition plate 10. Further provided close to the rear portion of the interior of the casing 1 is another partition wall 20 which is integrally formed with and extends downwardly from the supporting arm 2 into the casing 1 for constituting the cord compartment 12 between the partition wall 20 and the partition plate 10 and also for holding the distal portions of the cord guiding members 15 between the partition wall 20 and the bottom plate 4 for perfect securing of said guiding members 15 as is most clearly seen from FIG. 2. It should be noted here that since passages for the power cord 19 are formed by the cord guiding members 15 of L-shaped cross section, the inner side walls 1*b* and 1*c* of the casing 1 and the bottom plate 4 for passing the power cord 19 therethrough, the insertion and withdrawal of the power cord 19 into and from the cord compartment 12 is not hindered by the presence of the power cord 19 itself. In assembling, the power cord 19 directed toward the rear portion of the casing 1 through the passages in the cord guiding member 15 is led out of the casing 1 via a power cord outlet 21 formed in the rear wall 1*d* of the casing 1, while a lead wire 22 connecting the switch 18 with the motor M is directed to the motor side through a notch 23 (FIG. 4) formed at an upper edge of the partition plate 10 and also through the interior of the supporting arm 2.

It should also be noted here that the width of the cord insertion and withdrawal opening 3 of the bottom plate 4 and that of the corresponding rectangular opening in the bottom of the recess 6 are adapted to be slightly larger than the width of the cover plate member 14 for allowing said cover plate member 14 to extend into the lower side of the base portion 5 when opened, while the length of the cord insertion and withdrawal opening 3 is arranged to be shorter than that of the cover plate member 14, with the length of the rectangular opening 26 for the recess 6 being made slightly larger than that of said cover plate member 14 so that when the cover plate member 14 is closed, the forward end thereof is piled up on the bottom plate 4. Furthermore, there are provided a pair of spaced projections 29 formed adjacent to the free end on the inner surface of the plate member 14 so as to be inserted into an engaging opening 28 formed at a corresponding portion of the bottom plate 4 for engagement with opposite edges of the opening 28.

By the above arrangement, for accommodating the power cord 19 into the cord compartment 12, the cover plate member 14 is pulled open and the cord 19 led out of the casing 1 through the outlet 21 is brought under the base portion 5 to be introduced into the compartment 12 through the opening 26 in the recess 6 of the base portion 5 and the cord insertion and withdrawal opening 3 of the bottom plate 4 with subsequent closing of the cover plate member 14 in the above described manner. It should be noted that, for preventing the power cord 19 from any damage even if the base portion 5 is placed on a table or the like in the above state, a cut out portion 30 (FIG. 4) is formed in the lower edge of the rear wall 5*d* of the base portion 5 for passing the power cord 19 therethrough, and that the cover plate member 14 is also provided at its one side edge with a notch 31 for enabling the plate member 14 to be tightly closed when the power cord 19 has been accommodated in the compartment 12.

As is clear from the foregoing description, according to the arrangement of the present invention, assembling of the electric fan is extremely simplified since the cover plate member 14 is readily installed by merely inserting the partition plate 10 between the side walls of the casing 1, while owing to the construction in which the power cord is adapted to pass through the cord guiding portion 15 provided on the partition plate 10, such power cord is free from tangling with the portion of the cord inserted into the compartment 12 through the opening 3, and thus the cover plate arrangement for the power cord compartment convenient to use is advantageously presented.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An electric fan comprising a casing of rectangular cubic configuration for accomodating therein electrical components, said casing being integrally formed with a supporting arm extending upwardly therefrom for supporting a motor and blade assembly, and a base portion having a longitudinal recess formed therein the shape of said longitudinal recess being complementary to the shape of said casing and a first engaging portion provided at a forward end of said longitudinal recess for engagement with a corresponding forward end of said casing, said longitudinal recess being formed, in its rear wall at a rear end thereof, with a second engaging portion, and said casing being provided, at its rear lower edge corresponding to said second engaging portion, with a stepped portion which rides over said second engaging portion, at least one of said second engaging portion and said stepped portion being provided with a tapering face, the highest portion of the rear wall of said longitudinal recess being lower than the highest portion of the side walls thereof, wherein when said casing is positioned in said longitudinal recess, said casing is guided by said tapering face and is moved forward into said longitudinal recess for ensuring engagement between said engaging portion at the forward end of said recess and said corresponding forward end of said casing such that substantially all of said casing is positioned within said recess.

2. An electric fan as claimed in claim 1, further including a screw member which can be inserted from under said base portion through a bottom portion of said longitudinal recess for engagement with said casing, said bottom portion of said recess being recessed within said base portion such that when said screw member is inserted therein the head of said screw member is within the bottom portion, said screw member, upon threading thereof into said casing, drawing said casing into said longitudinal recess through movement of said casing guided by said tapering face for ensuring engagement between said engaging portion at the forward end of said recess and said corresponding forward end of said casing.

3. An electric fan as claimed in claim 2, wherein said bottom portion of said longitudinal recess has a first raised portion under which a head portion of said screw member is accomodated, said casing has formed in its bottom portion a second raised portion which rides over said first raised portion wherein said second raised portion is deviated in its position from said first raised portion by a predetermined amount to form a space between said first and second raised portions.

4. An electric fan comprising a casing of rectangular cubic configuration for accommodating therein electrical parts, said casing being integrally formed with a supporting arm extending upwardly therefrom for supporting motor and blade assembly, a base portion having a longitudinal recess formed therein and a first engaging portion provided at a forward end of said longitudinal recess for engagement with a corresponding forward end of said casing, said longitudinal recess being formed, in its rear wall at a rear end thereof, with a second engaging portion, and said casing being provided, at its rear lower edge corresponding to said second engaging portion, with stepped portion which rides over said second engaging portion, with at least either one of said second engaging portion and said stepped portion being provided with tapering face formed in such a manner that when said casing is placed in said longitudinal recess, said casing guided by said tapering face is moved forward into said longitudinal recess for ensuring engagement between said engaging portion at the forward end of said recess and said corresponding forward end of said casing, and a cover plate arrangement further including a partition plate member to be inserted into said casing in a position between side walls of said casing through the bottom portion of said casing, and a bottom plate member to close said bottom portion of said casing so as to hold said partition plate member in position in said casing for dividing said casing into a first compartment for accommodating the electrical parts and a second compartment for accommodating a power cord of said electric fan, said partition plate member being provided at its lower edge with a cover plate member integrally formed with said partition plate member through hinged portion for selectively opening and closing a cord insertion and withdrawal opening for said second compartment formed in said bottom plate member of said casing.

5. An electric fan as claimed in claim 4, wherein said partition plate member is arranged to be inserted into said casing through a pair of guide grooves formed in the side walls of said casing.

6. An electric fan as claimed in claim 4, wherein said partition plate member is further provided with power cord guiding portion extending outwardly therefrom, said power cord guiding portion being held between rib member provided on inner face of said side wall and said bottom plate member of said casing for fixing said partition plate member in position.

7. An electric fan as claimed in claim 6, wherein said power cord guiding portion extending from said partition plate member has L-shaped cross section to form passage for the power cord together with said inner face of said side walls and said bottom plate member of said casing for passing the power cord through said passage.

* * * * *